US006914503B2

(12) United States Patent
Saruwatari et al.

(10) Patent No.: US 6,914,503 B2
(45) Date of Patent: Jul. 5, 2005

(54) ELECTROMAGNETIC RELAY

(75) Inventors: Yojiro Saruwatari, Kumamoto (JP); Keisuke Yano, Kumamoto-ken (JP); Shinichi Furusyo, Kumamoto (JP); Tetsuya Fujiwara, Kumamoto (JP); Ryota Minowa, Yamaga (JP)

(73) Assignee: Omron Corporation, Kyoto (JP)

( * ) Notice: Subject to any disclaimer, the term of this patent is extended or adjusted under 35 U.S.C. 154(b) by 0 days.

(21) Appl. No.: 10/829,671

(22) Filed: Apr. 22, 2004

(65) Prior Publication Data

US 2004/0257182 A1 Dec. 23, 2004

(30) Foreign Application Priority Data

Apr. 24, 2003 (JP) ..... 2003-120307

(51) Int. Cl.[7] ..... H01H 73/12; H01H 73/14
(52) U.S. Cl. ..... 335/78; 335/17; 335/202
(58) Field of Search ..... 335/17, 78–86, 335/202

(56) References Cited

U.S. PATENT DOCUMENTS 5,081,436 A * 1/1992 Nishi et al. ..... 335/83
6,498,552 B1 * 12/2002 Lozano Rico ..... 335/78

OTHER PUBLICATIONS

Patent Abstracts of Japan, Publication No. 10–208600 dated Aug. 7, 1998, 1 pg.
Patent Abstracts of Japan, Publication No. 10–125195 dated May 15, 1998, 1 pg.

* cited by examiner

*Primary Examiner*—Ramon M. Barrera
(74) *Attorney, Agent, or Firm*—Osha-Liang LLP

(57) ABSTRACT

An electromagnetic relay having superior visibility and a light-emitting device easy to mount. A coil block and a contact opening and closing mechanism are disposed on a base plate and covered with a case, and the electromagnetic relay magnetizes and demagnetizes the coil block via coil terminals to turn a movable core and moves a movable contact part to open and close a contact. Electrical connection portions of the coil terminals are projected upwardly through the top side of the case. A light-emitting device which emits light by the energization of the coil terminals and a holder which holds the light-emitting device are disposed on the top side of the case on the side opposite to a position where the electrical connection portions of the coil terminals of the case are projected. Lead wires connected to the light-emitting device are electrically connected to the electrical connection portions of the coil terminals.

5 Claims, 17 Drawing Sheets

ELECTROMAGNETIC RELAY

CROSS-REFERENCE TO RELATED APPLICATIONS

This application claims priority from Japanese Application JP2003-120307, filed on Apr. 24, 2003.

BACKGROUND OF THE INVENTION

1. Field of the Invention

The present invention relates to an electromagnetic relay.

2. Description of the Related Art

There is a related art electromagnetic relay in which an operation display device (light-emitting device) made of a luminescent resin is integrally provided in a casing (refer to, for example, Patent Document 1).

There is another related art electromagnetic relay in which an operation display LED (light-emitting device) is previously disposed at a terminal and is formed into a coil block integrally with predetermined members to facilitate the positioning and fixation of the LED (refer to, for example, Patent Document 2).

Patent Document 1 is JP-A-10-125195.

Patent Document 2 is JP-A-10-208600.

SUMMARY OF THE INVENTION

However, in the construction of either of the above-mentioned electromagnetic relays, the light-emitting device is disposed in an internal space covered with the case. For this reason, the case is formed of a material having optical transmission characteristics, but has a problem in terms of visibility from the outside. There is also the problem that the light-emitting device needs to be fixed in a limited space within the internal space and the fixed state of the light-emitting device lacks stability. Furthermore, in the case where the light-emitting device is mounted on a printed circuit board, glass dust produced from the printed circuit board may also become a cause which brings about contact failure of contacts and the like.

The invention provides, therefore, an electromagnetic relay which is superior in visibility and is provided with a light-emitting device easy to mount.

To solve the above-mentioned problem, the invention provides an electromagnetic relay provided with a coil block and a contact opening and closing mechanism which are disposed on a base plate and covered with a case, and operative to magnetize and demagnetize the coil block to turn a movable core and move a movable contact part to open and close a contact. The electromagnetic relay includes a light-emitting device which emits light during magnetization of the coil block, and a holder which holds the light-emitting device, the light-emitting device and the holder being disposed on a top side of the case.

According to this construction, it is possible to mount the light-emitting device after the fitting of the case, whereby it is possible to easily perform the work of mounting the light-emitting device. It is also possible to improve the visibility of the light-emitting device by exposing the same.

The case preferably includes an engagement part which is elastically deformed while the holder is being mounted, and is restored to its original shape after the holder has been mounted, and the engagement part preferably has a top end portion where an engagement claw to engage with a top edge portion of the holder is formed, whereby the work of mounting the holder can be easily performed.

The case is preferably molded from a resin and has engagement holes with which engagement projections provided on the base plate are respectively brought into engagement, and the engagement claw of the engagement part is preferably able to be formed with a slide mold which forms the engagement holes, whereby the electromagnetic relay can be inexpensively fabricated.

The holder preferably includes a holder body which holds the light-emitting device, an operating portion which moves the movable core by directly pressing the movable core through a depressing operation of the operating portion, and elastic arm portions which connect the holder body and the operating portion and are elastically deformed by the depressing operation of the operating portion, because the electromagnetic relay can be provided with not only the function of holding the light-emitting device but also a movement confirming function, whereby the electromagnetic relay can be simplified in construction and can be improved in assembling work.

The electromagnetic relay preferably further includes an indicator to be driven with a turning movement of the movable core, and a display guide portion which provides a space in which the indicator can move is preferably disposed to project from a central portion of the top side of the case, the holder body of the holder being positioned between the engagement part and the display guide portion, whereby the electromagnetic relay can be designed to have a compact construction from which an unnecessary space is excluded.

BRIEF DESCRIPTION OF THE DRAWINGS

The invention will become more readily appreciated and understood from the following detailed description of preferred embodiments of the invention when taken in conjunction with the accompanying drawings, in which.

DETAILED DESCRIPTION OF THE INVENTION

Figure 1:
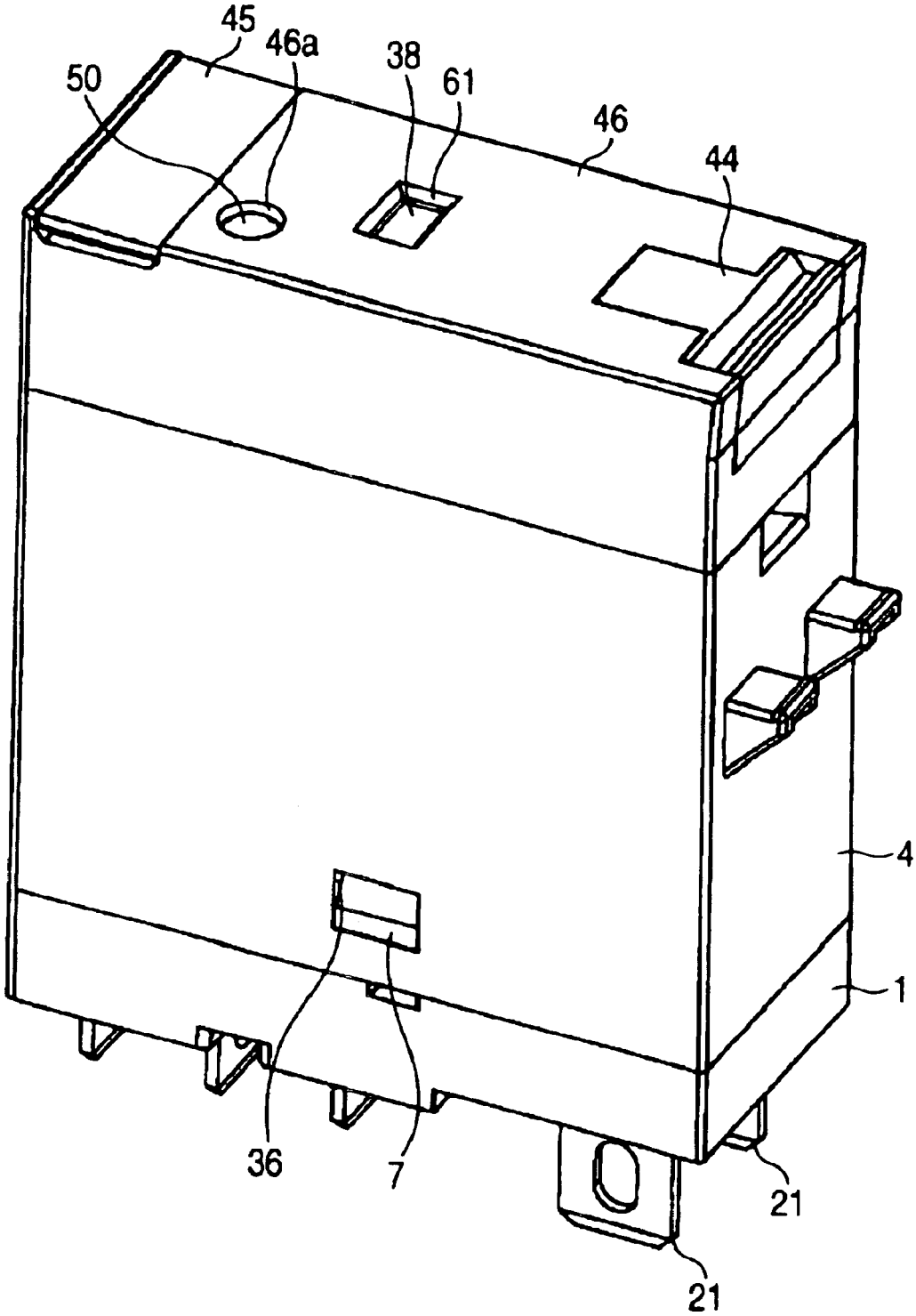
FIG. 1 is a perspective view of an electromagnetic relay according to a preferred embodiment of the invention.

Preferred embodiments of the invention will be described below in detail with reference to the accompanying drawings.

FIGS. 1 to 4 show an electromagnetic relay. This electromagnetic relay is generally constructed in such a manner that a coil block 2 and a contact opening and closing mechanism 3 are provided on a base plate 1 and covered with a case 4 and a display block 5 is disposed on the top side of the case 4.

Figure 3:
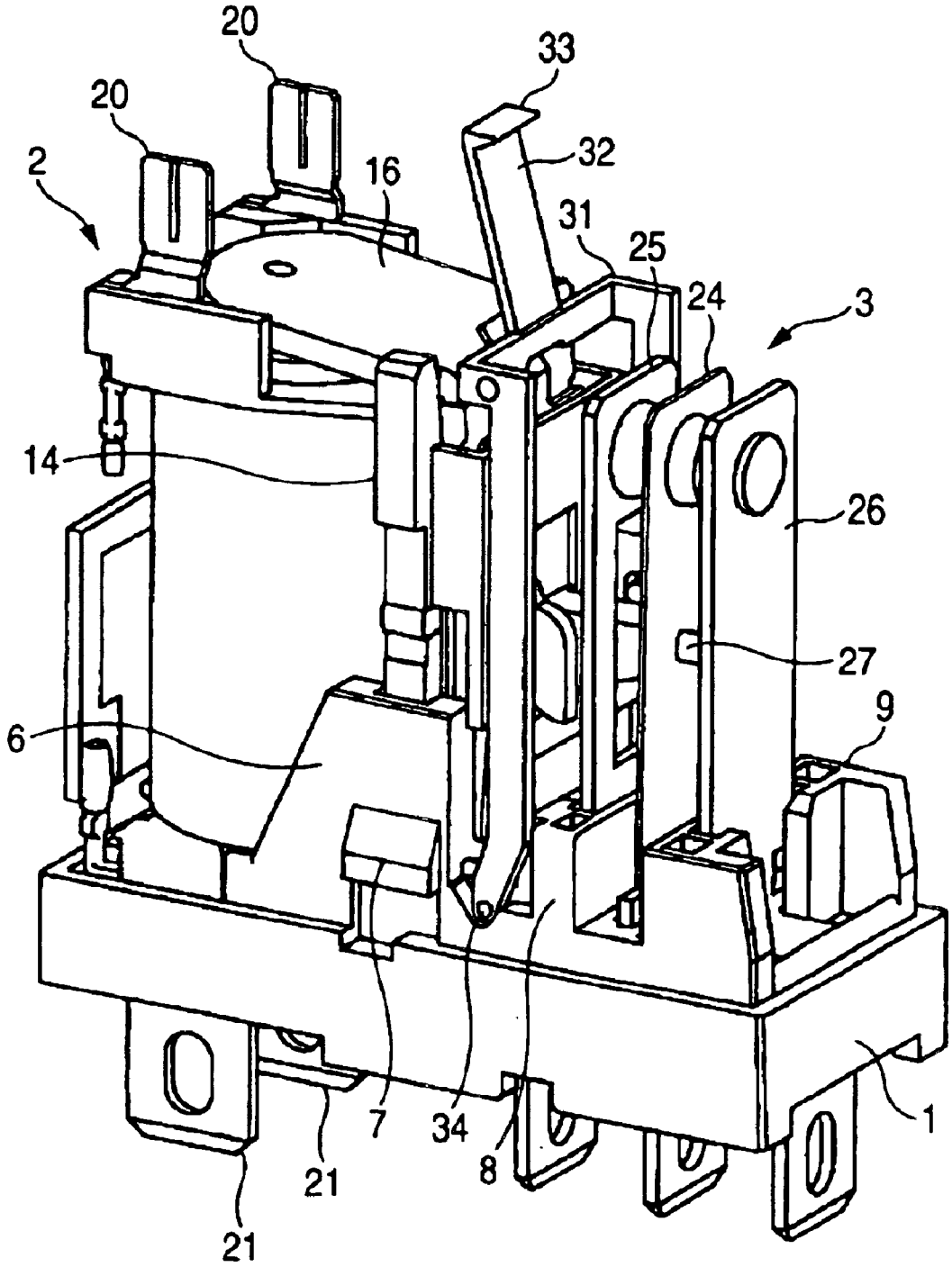
FIG. 3 is a perspective view showing a state in which a case is removed from the state shown in FIG. 2.
Figure 5:
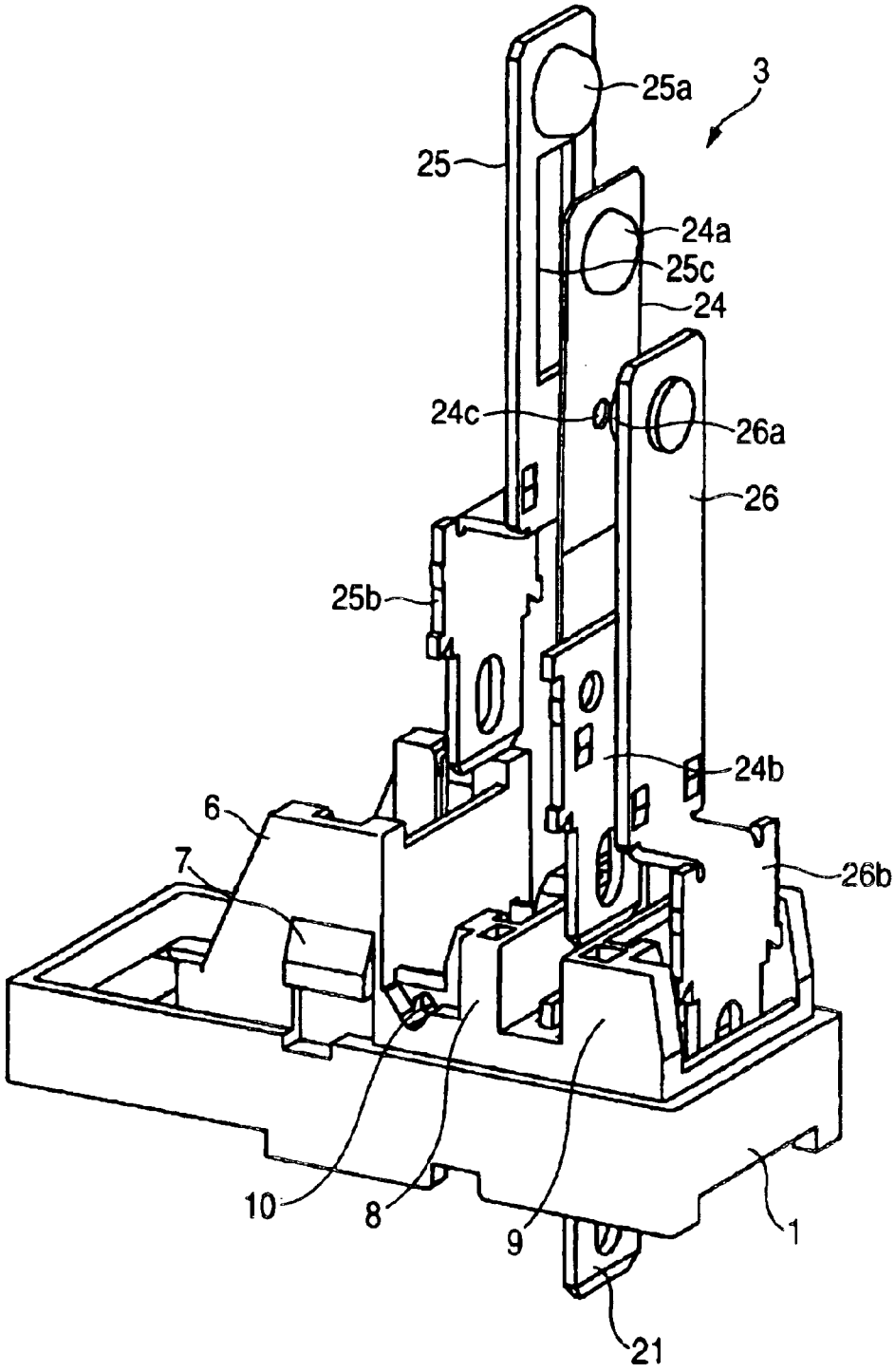
FIG. 5 is an exploded perspective view of a base plate and a contact opening and closing mechanism.

As shown in FIGS. 3 and 5, the base plate 1 is sectioned by a first insulating wall 6 into a first area in which the coil block 2 is disposed and a second area in which the contact opening and closing mechanism 3 is disposed. An engagement projection 7 is formed on a side portion of the first insulating wall 6, and is brought into engagement with an engagement hole 36 (which will be described later) of the case 4 to secure the case 4 to the base plate 1. The second area is sectioned by a second insulating wall 8 and a third insulating wall 9 into an area in which a first stationary contact part 25 is fixed, an area in which a movable contact part 24 is fixed, and an area in which a second stationary contact part 26 is fixed. A bearing hole 10 is formed in a side portion of the second insulating wall 8, and an indicator 31 which will be described later is turnably supported by the bearing holes 10.

Figure 4:
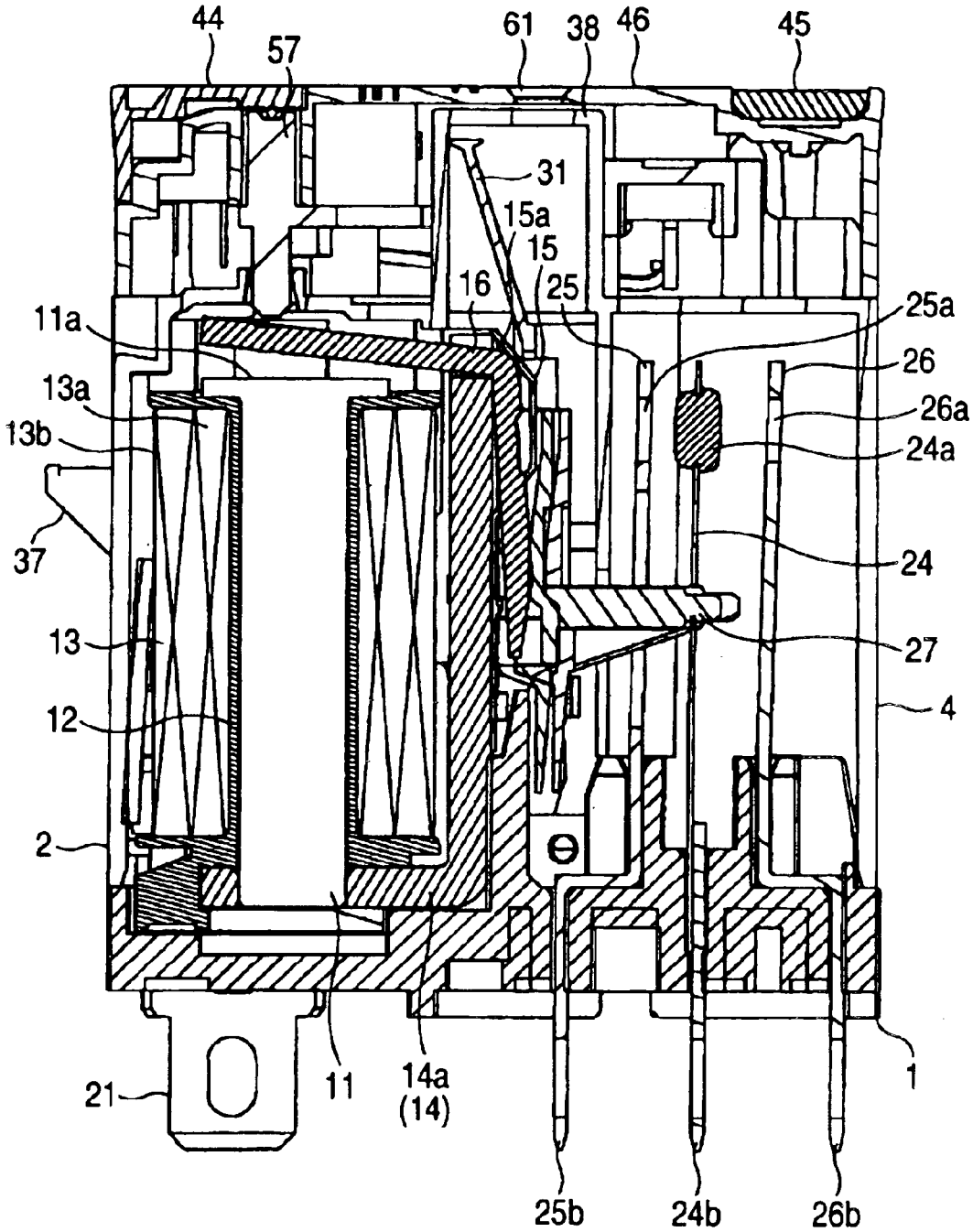
FIG. 4 is a cross-sectional view of FIG. 1.
Figure 8:
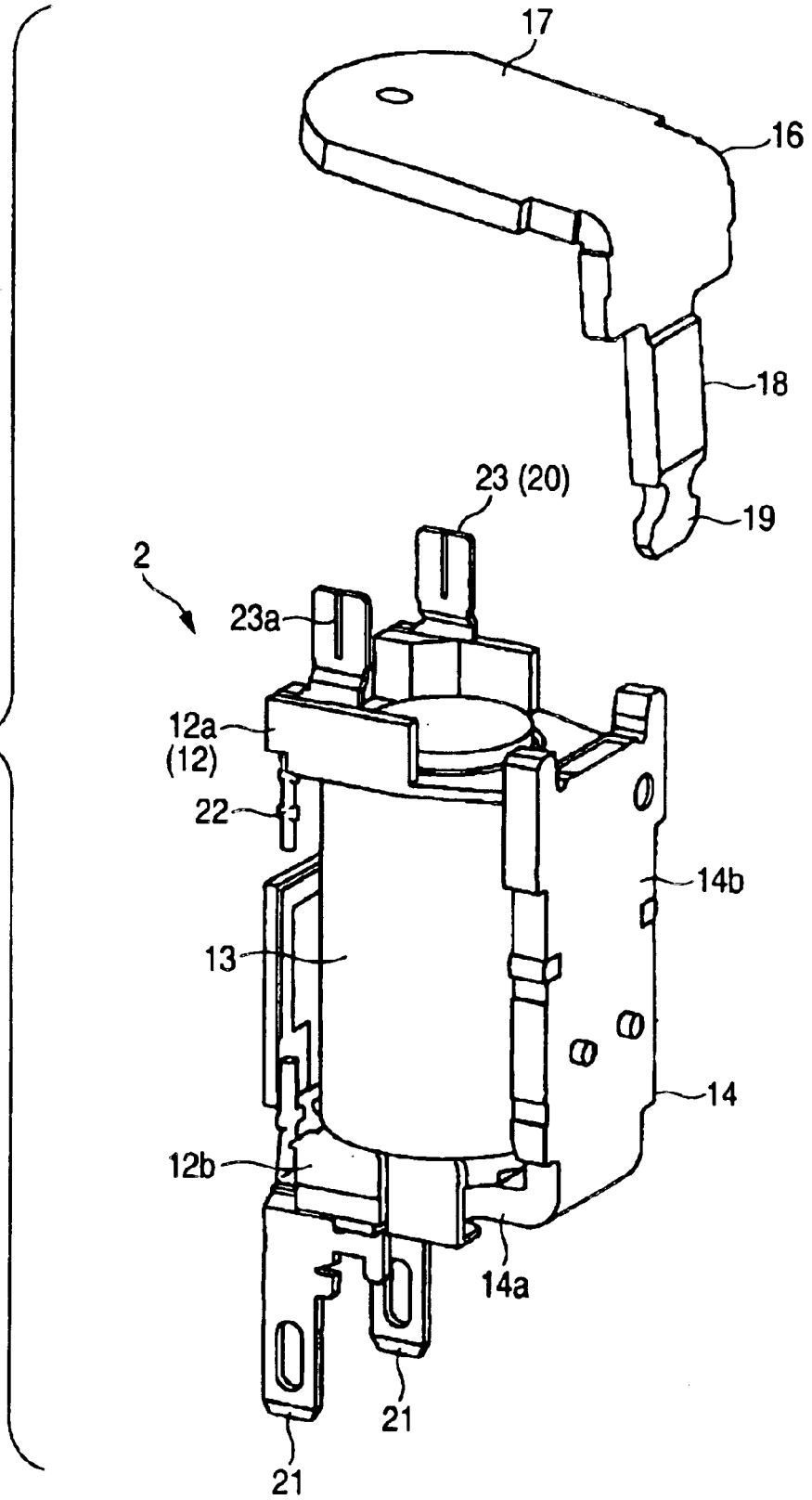
FIG. 8 is a perspective view of a coil block and a movable core.

As shown in FIGS. 4 and 8, the coil block 2 has a construction in which a coil 13 is wound around a spool 12 fitted on a core 11. A horizontal plane portion 14*a* of a yoke 14 which is bent in an approximately L-like shape is fixed to the bottom end portion of the core 11 by caulking. A vertical plane portion 14*b* of the yoke 14 extends upwardly along the wound coil 13, and a hinge spring 15 is fixed to one side surface of the yoke 14. A movable core 16 is swingably supported on the top end portion of the vertical plane portion 14*b* of the yoke 14.

As shown in FIG. 8, the movable core 16 has a pressure receiving portion 18 which is decreased in width and is extended via a bent portion from an attracted portion 17 to be attracted by an attraction surface 11*a* of the core 11. A connection portion 19 to be connected to a card 27 which will be described later is formed at one end of the pressure receiving portion 18. The movable core 16 is pressed at the pressure receiving portion 18 by a pressing part 15*a* of the hinge spring 15, while when the coil block 2 is in a demagnetized state, the movable core 16 turns so that the attracted portion 17 moves away from the attraction surface 11*a* of the core 11.

As shown in FIG. 8, the spool 12 has a top end flange portion 12*a* to which first coil terminals 20 are fixed, and a bottom end flange portion 12*b* to which second coil terminals 21 are fixed. The first coil terminals 20 have bottom end leg portions 22 around which the opposite ends of the coil 13 are to be wound, respectively, while lead wires 54 extending from an LED 50 which will be described later are respectively connected to electrical connection portions 23 on the top end surface of the spool 12. Each of the electrical connection portions 23 has ridges 23*a* formed to extend vertically in its central portion, so that it is possible to positively establish electrical connection between the respective electrical connection portions 23 and the lead wires 54.

As shown in FIG. 4, the coil 13 includes a first coil 13*a* which is wound around the trunk portion of the spool 12 and is connected at opposite ends to the first coil terminals 20, respectively, and a second coil 13*b* which is wound in the outer circumferential portion of the wound coil 13 and is connected at opposite ends to the second coil terminals 21, respectively. Accordingly, when a voltage is applied across the second coil terminals 21 to energize the second coil 13*b* wound on the outer circumferential side of the coil 13, induced electromotive force is generated in the first coil 13*a* on the inner circumferential side of the coil 13 by an electromagnetic induction action, whereby a potential difference can occur between the first coil terminals 20.

As shown in FIG. 5, the contact opening and closing mechanism 3 includes the movable contact part 24, the first stationary contact part 25 and the second stationary contact part 26 which are respectively disposed on the opposite sides of the movable contact part 24. The movable contact part 24 has a plate-like shape, and a movable contact 24*a* which is exposed on the opposite sides of the top end portion of the movable contact part 24 is integrated with the top end portion, while a terminal portion 25*b* is disposed at the bottom end portion of the movable contact part 24. A through-hole 24*c* is formed in the movable contact part 24 in the vicinity of the bottom portion of the movable contact 24*a*. The first stationary contact part 25 and the second stationary contact part 26 have plate-like shapes, and a first stationary contact 25*a* and a second stationary contact 26*a* with either of which the movable contact 24*a* selectively comes into contact are respectively integrated with the top end portions of the first and second stationary contact parts 25 and 26. The bottom sides of both stationary contact parts 25 and 26 are respectively bent in crank-like shapes to constitute terminal portions 25*b* and 26*b* which project from the bottom side of the base plate 1. The top end side of the first stationary contact part 25 has a slit 25*c* formed to extend vertically downwardly from a location near the bottom portion of the first stationary contact 25*a*.

Figure 7:
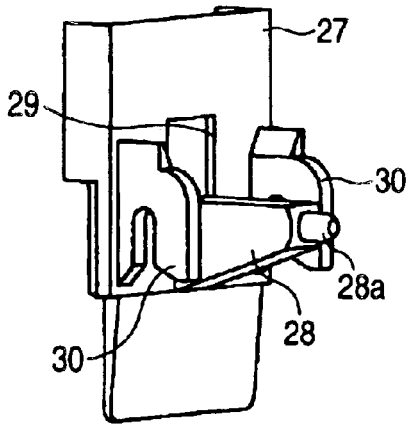
FIG. 7 is a perspective view of a card.

The movable contact part 24 is moved by the card 27 which is engaged with one end portion of the movable core 16. As shown in FIG. 7, the card 27 has a press-inserting projecting portion 28 in the central portion of its plate-like body, and a projection 28*a* provided at the projecting end of the press-inserting projecting portion 28 is inserted through the through-hole 24*c* of the movable contact part 24. A rectangular hole 29 is formed in the vicinity of the top side of the press-inserting projecting portion 28, and the connection portion 19 of the movable core 16 is connected to the rectangular hole 29. Approximately U-shaped guide receiving portions 30 are respectively formed in the opposite side portions of the card 27.

Figure 6:
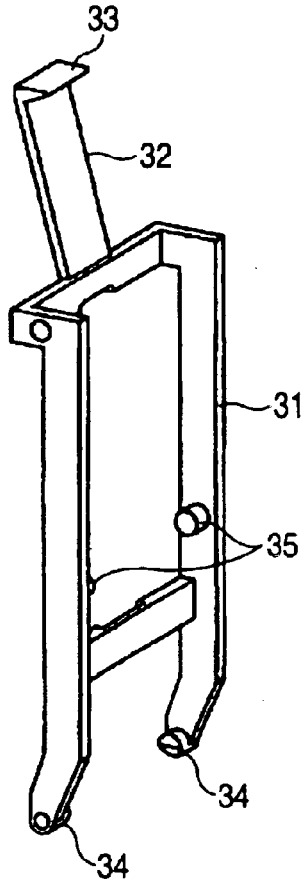
FIG. 6 is a perspective view of an indicator.

The movement of the movable contact part 24 by the card 27 can be easily confirmed by means of an indicator 31. As shown in FIG. 6, the indicator 31 has an approximately frame-like shape, and has a display part 32 formed in the center of the top-end joining portion of the indicator 31. The extending end of the display part 32 is bent approximately at right angles and constitutes a visible portion 33. Support pins 34 which project in mutually opposite directions are respectively formed at the bottom ends of the opposite side portions of the indicator 31, and the respective support pins 34 are brought into engagement with the bearing holes 10 of the base plate 1, whereby the indicator 31 is turnably secured to the bearing holes 10. Guide projections 35 which project in mutually opposite directions are respectively formed in the centers of the opposite side portions of the indicator 31, and the respective guide projections 35 are guided by the guide receiving portions 30 of the card 27 so that both the indicator 31 and the card 27 can move integrally. The turning center (the support pins 34) of the indicator 31 is positioned on the opposite side to the display part 32 with respect to the pressing position of the card 27. Accordingly, the amount of movement of the display part 32 can be amplified with respect to the amount of movement of the card 27.

Figure 2:
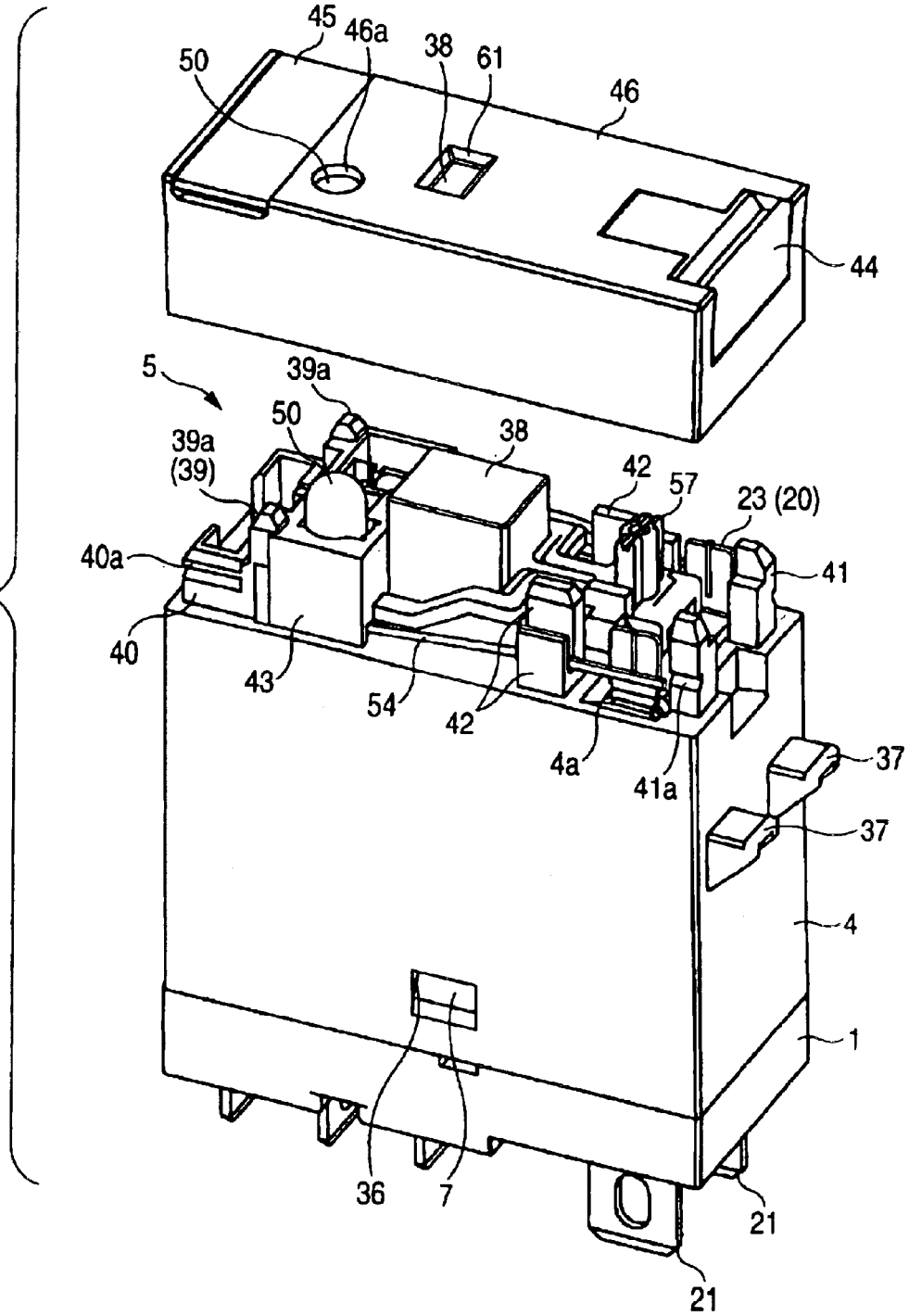
FIG. 2 is a perspective view of a state in which the cover shown in FIG. 1 is removed.

As shown in FIG. 2, the case 4 has a box-like shape opened at the bottom, and is obtained by molding a resin material having optical transmission characteristics. Engagement holes 36 with which the engagement projections 7 of the base plate 1 disengageably engage are respectively formed in the centers of the bottom portions of opposite sides of the case 4. Claw portions 37 on which a user is to hook his/her fingers to remove the electromagnetic relay from a panel (not shown) disposed in a vertical plane after the electromagnetic relay has been fitted to the panel are formed on one end side of the case 4. A display guide portion 38 is disposed to project from the central portion of the top side of the case 4, an engagement part 39 and a reinforcing portion 40 are projectingly disposed on one end side of the same top side, and first guide parts 41 and second guide parts 42 are projectingly disposed on the other end side of the same top side and slits 4*a* are also formed on the other end side. The display guide portion 38 has a box-like shape and provides a space in which the display part 32 of the indicator 31 can move. The engagement part 39 guides an LED holder 43 between itself and the display guide portion 38, and prevents the LED holder 43 from coming off the case 4, by means of engagement claws 39*a* provided at the top end of the engagement part 39. The reinforcing portion 40 reinforces the engagement part 39, and is provided with engagement claws 40*a* with which second engagement claws 69 of a cover 46 (to be described later) disengageably engage. Each of the first guide parts 41 has an engagement groove 41*a* which is formed on its one side in the central portion thereof and with which the corresponding one of first engagement claws 62*a* (refer to FIG. 11) of the cover 46 is to engage, and is tapered toward its top end so that the cover 46 can be easily fitted. Each of the second guide parts 42 is made of a pair of juxtaposed projecting plates and guides the corresponding one of the lead wires 54 extending from the LED 50. The electrical connection portions 23 of the first coil terminals 20 are respectively inserted through the slits 4*a*.

The display block 5 has a construction in which, as shown in FIG. 2, the LED holder 43 is disposed on the top side of the case 4 and is covered with the cover 46 provided with an operating lever 44 and a display panel 45.

Figure 9A:
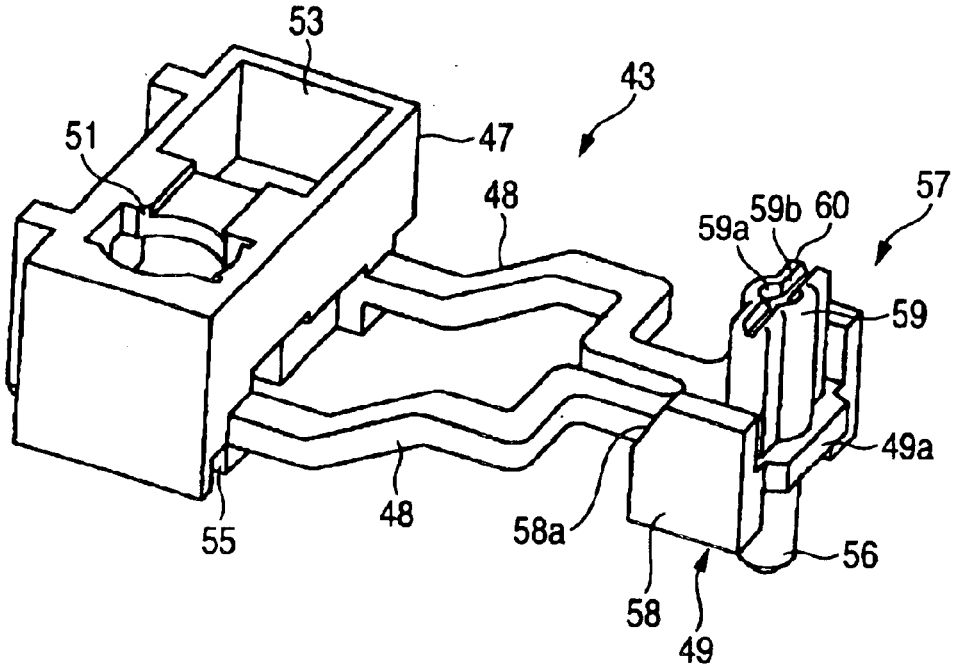
FIG. 9A is a perspective view of an LED holder.
Figure 9B:
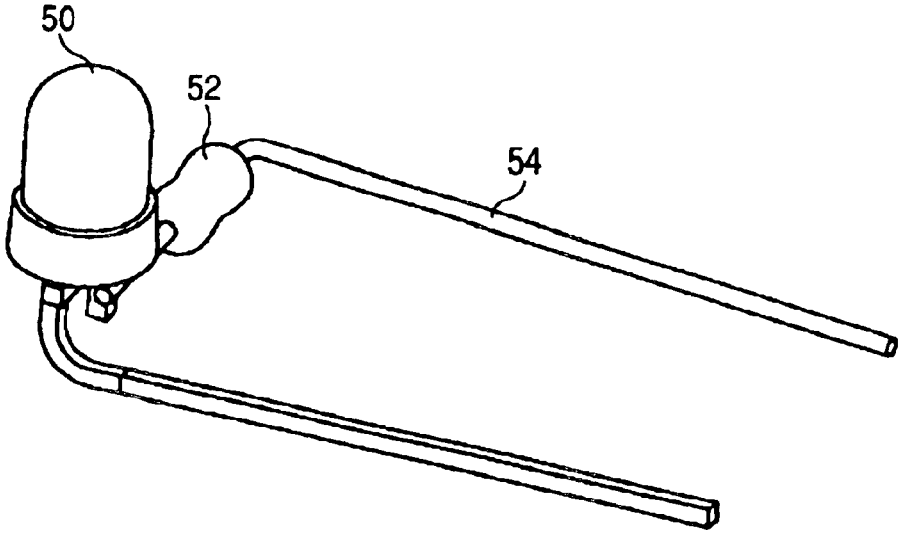
FIG. 9B is a perspective view of an LED.
Figure 10A:
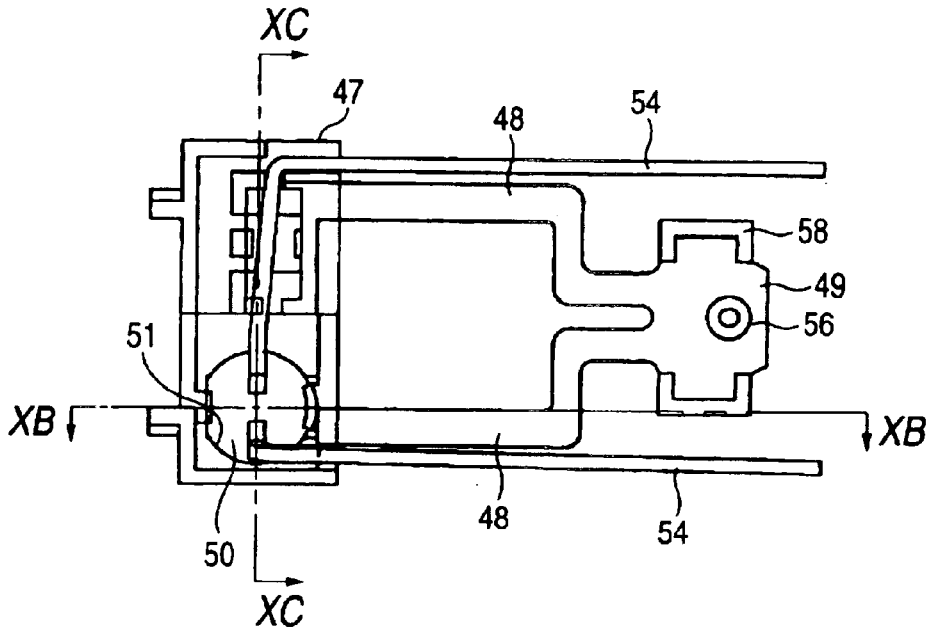
FIG. 10A is a bottom view of the LED holder.
Figure 10B:
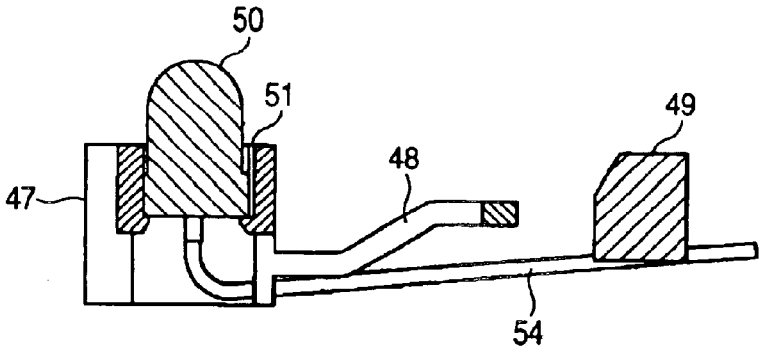
FIG. 10B is a cross-sectional view taken along line A—A of FIG. 10A.
Figure 10C:
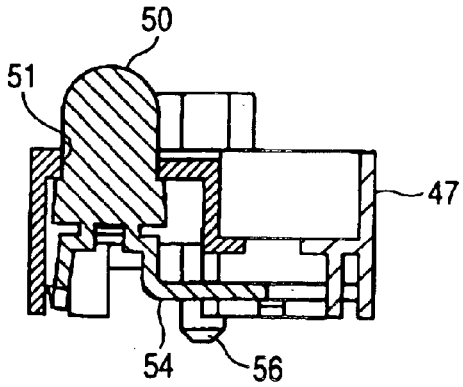
FIG. 10C is a cross-sectional view taken along line B—B of FIG. 10C.

As shown in FIG. 9A, the LED holder 43 has a construction in which elastic arm portions 48 are extended from a holder body 47 and an operating portion 49 is formed at the extending end of the elastic arm portions 48.

The holder body 47 has a guide hole 51 for guiding the LED 50 and an escape hole 53 for preventing interference of the holder body 47 with a resistor 52 connected to the LED 50. The lead wires 54 extending from the LED 50 are led out via cutouts 55 formed at corners of the bottom side of the holder body 47.

The elastic arm portions 48 are formed to be respectively extended toward one side from opposite side edges of the holder body 47, extended obliquely upwardly, bent toward each other, and joined to the operating portion 49. Accordingly, the deformation of the elastic arm portions 48 is facilitated and the interference of the elastic arm portions 48 with projecting portions of the case 4 can be avoided.

The operating portion 49 is made of a pressing portion 56 which projects downwardly from the central portion of the bottom side of a support plate 49*a* formed continuously with the elastic arm portions 48, a first pressure receiving portion 57 which projects upwardly from the central portion of the top side of the support plate 49*a*, and second pressure receiving portions 58 which respectively project upwardly from opposite side portions of the top side of the support plate 49*a*. The pressing portion 56 can press one end portion of the movable core 16 to move the movable contact part 24 via the card 27. The first pressure receiving portion 57 is made of a central cylindrical portion 59 and extending portions 60 which are respectively formed to extend along the cylindrical portion 59 on opposite sides thereof. A depressed portion 59*a* is provided in the center of the cylindrical portion 59, and groove portions 59*b* are formed continuously with the extending portions 60 and the cylindrical portion 59. The depressed portion 59*a* prevents a positional deviation of pointed matter such as a pen when the first pressure receiving portion 57 is being pressed by the pointed matter, while the groove portions 59*b* prevent a positional deviation of plate-shaped matter such as a screwdriver when the first pressure receiving portion 57 is being pressed by the plate-shaped matter. Each of the second pressure receiving portions 58 has an inclined surface 58*a* formed by cutting a top corner closer to the holder body 47. When the inclined surfaces 58*a* are pressed by pressing projections 74 of the operating lever 44, the attracted portion 17 of the movable core 16 can be pressed by the pressing portion 56.

Accordingly, the above-described LED holder 43 has a construction capable of not only holding the LED 50 but also causing the movable core 16 to move by means of the operating portion 49. Therefore, the LED holder 43 can be reduced in the number of component parts and can be fabricated inexpensively. In addition, the LED holder 43 is superior in workability because the LED holder 43 can be assembled merely by being placed on the top side of the case 4.

Figure 11:
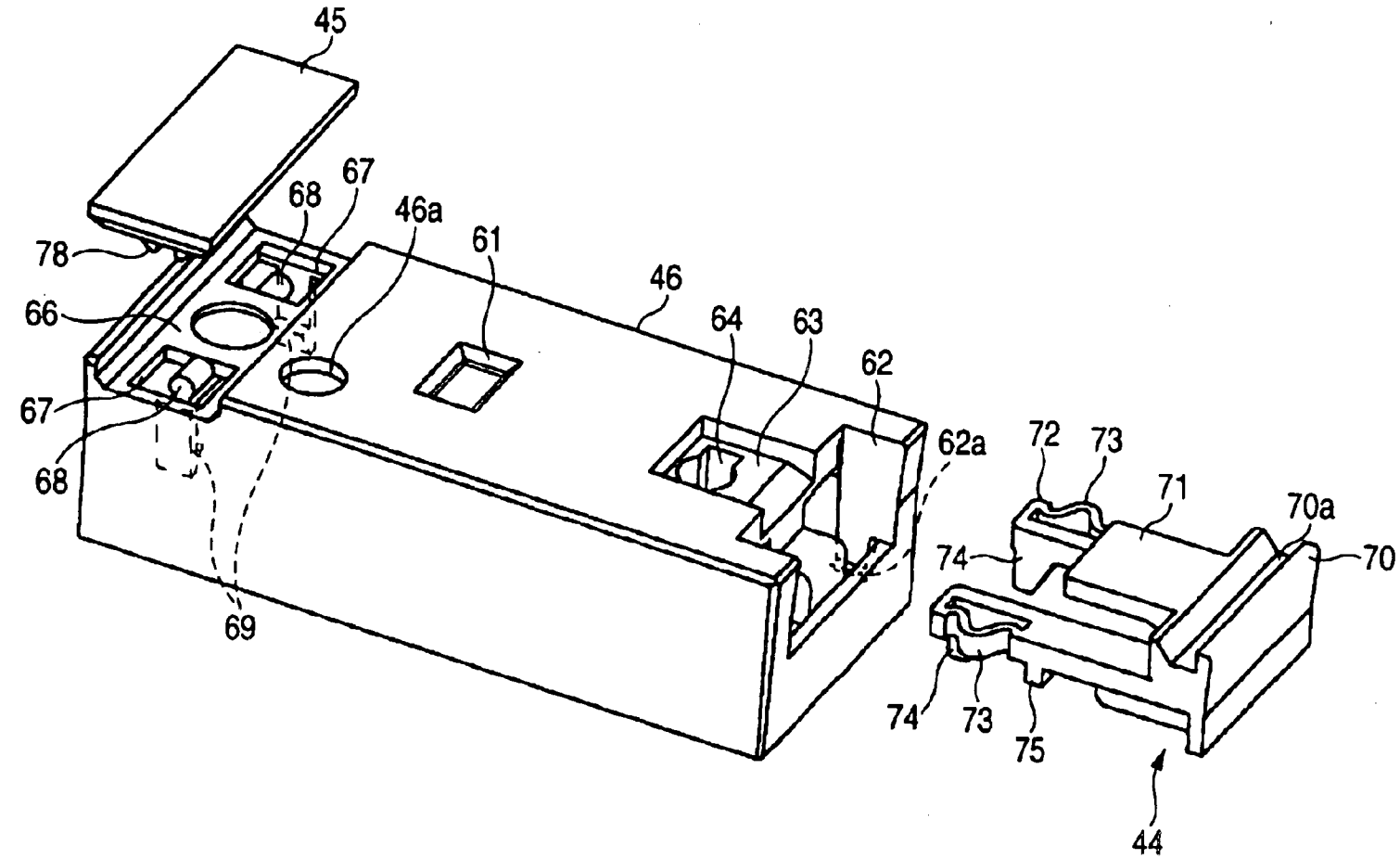
FIG. 11 is an exploded perspective view of a cover.
Figure 12A:
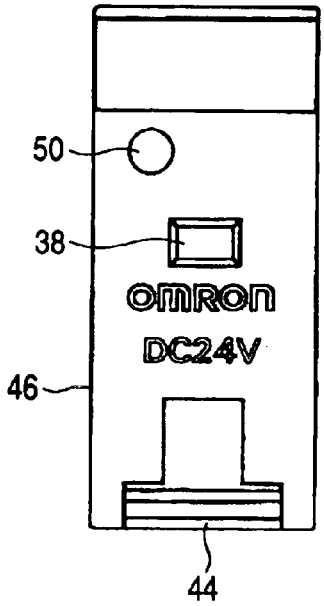
FIG. 12A is a top plan view of the cover.
Figure 12B:
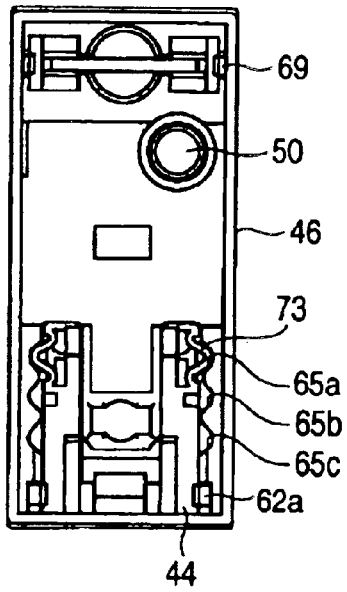
FIG. 12B is a bottom plan view of the cover.
Figure 12C:
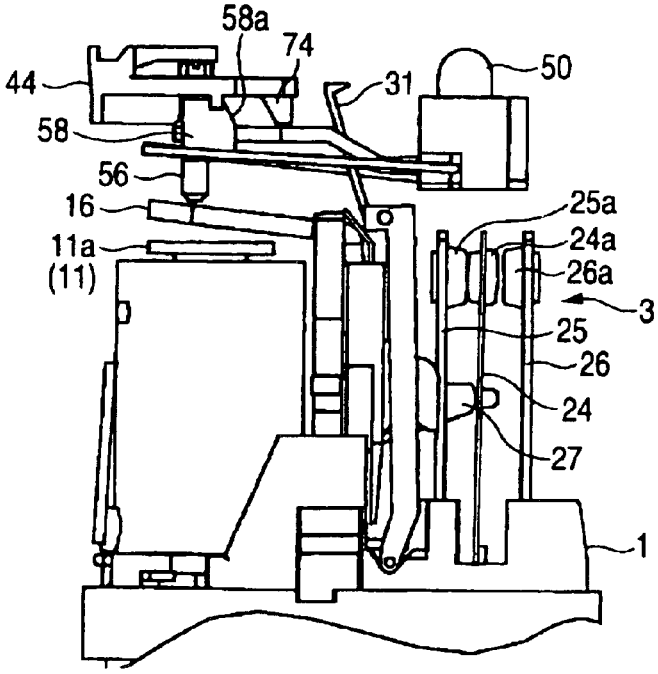
FIG. 12C is a partial front elevational view showing an internal mechanism.

As shown in FIGS. 11 to 12C, the cover 46 has a box-like shape opened at the bottom, and a window portion 61 is formed in the central portion of the top wall of the cover 46. The window portion 61 enables the user to view the display part 32 when the indicator 31 moves. An opening 62 into which the operating lever 44 is to be fitted and a depressed portion 63 which is formed continuously with the opening 62 and is made narrower than the opening 62 are formed in one end portion of the cover 46. The opening 62 is opened in the top side and one end side of the cover 46. The depressed portion 63 is positioned on the top side of the cover 46, and an inserting hole 64 which is positioned so that the first pressure receiving portion 57 of the LED holder 43 can be press-inserted into the inserting hole 64 is formed in the central portion of the depressed portion 63. First, second and third engagement receiving portions 65*a*, 65*b* and 65*c*, which are respectively made of three pairs of receding portions respectively arranged on the opposite sides of the opening 62 in a continuous wave-like form, are formed on the bottom side of the top wall (ceiling surface) of the cover 46. The first, second and third engagement receiving portions 65*a*, 65*b* and 65*c* stop the operating lever 44 (to be described later) at a closing position, a first opening position and a second opening position, respectively. First engagement claws 62*a* are respectively formed on inside surfaces of the opening 62 so that the respective engagement grooves 41*a* of the first guide parts 41 projecting from the top side of the case 4 engage with and disengage from the first engagement claws 62*a*. A panel-fitting depressed portion 66 into which the display panel 45 is to be fitted is formed in the other end portion of the cover 46. Rectangular communication holes 67 are formed in the panel-fitting depressed portion 66 on the opposite sides thereof, and mounting portions 68 project from the respective communication holes 67. Each of the mounting portions 68 has a rod-like shape in top plan view, and has a cross-sectional shape in which a trapezoidal portion which becomes gradually wider downwardly is extended from a circular portion. The mounting portions 68 extend in the width direction of the cover 46 on the reverse side of the depressed portion 66, and one end of each of the mounting portions 68 is formed as a free end within the respective one of the communication holes 67. The display panel 45 is not only secured to the mounting portions 68, but the mounting portions 68 also serve to reinforce a portion which is thin-walled owing to the formation of the depressed portion 63, and further serve to improve resin flows during a molding process. The second engagement claws 69 which extend vertically in the vicinity of the respective communication holes 67 are formed in inside surfaces of the cover 46, and disengageably engage with the respective engagement claws 40*a* formed on the reinforcing portion 40 of the case 4. Owing to the presence of the communication holes 67, the cover 46 can be molded without the need for a slide mold in spite of its construction in which the second engagement claws 69 are formed on the inside surfaces. A through-hole 46*a* in order to expose the LED 50 is formed in the vicinity of the window portion 61.

The operating lever 44 has an operating portion 70, a closing portion 71 and engagement portions 72, as shown in FIG. 11. The operating portion 70 closes the opening 62 of the cover 46 on its top side and its end side. A groove portion 70*a* which extends in the width direction of the operating portion 70 is formed in the top side of the operating portion 70. The groove portion 70*a* is used by the user when the user is to slide the operating lever 44 with respect to the cover 46 by means of the nail of any of his/her fingers hooked on the groove portion 70*a*. The closing portion 71 extends from the operating portion 70 in the horizontal direction and is positioned in the depressed portion 63, thereby covering the first pressure receiving portion 57 positioned in the inserting hole 64. The engagement portions 72 extend from the operating portion 70 and are positioned under the opposite sides of the closing portion 71. Hill-shaped elastic swollen portions 73 are respectively provided on side portions of the extending ends of the engagement portions 72, and the pressing projections 74 are respectively provided on the bottom sides of the extending ends of the engagement portions 72. The elastic swollen portions 73 disengageably engage with any of the first to third engagement receiving portions 65*a* to 65*c* formed on the ceiling surface of the cover 46, and stop the operating lever 44 at any of the closing position (refer to FIG. 12), the first opening position (refer to FIG. 13) and the second opening position (refer to FIG. 14). The respective pressing projections 74 press the second pressure receiving portions 58 of the LED holder 43 when the operating lever 44 is slid. Securing projections 75 for preventing the operating lever 44 from coming off the cover 46 by coming into abutment with the guide projections 35 projecting from the top side of the case 4 are formed on the bottom sides of the respective engagement portions 72.

Figure 15A:
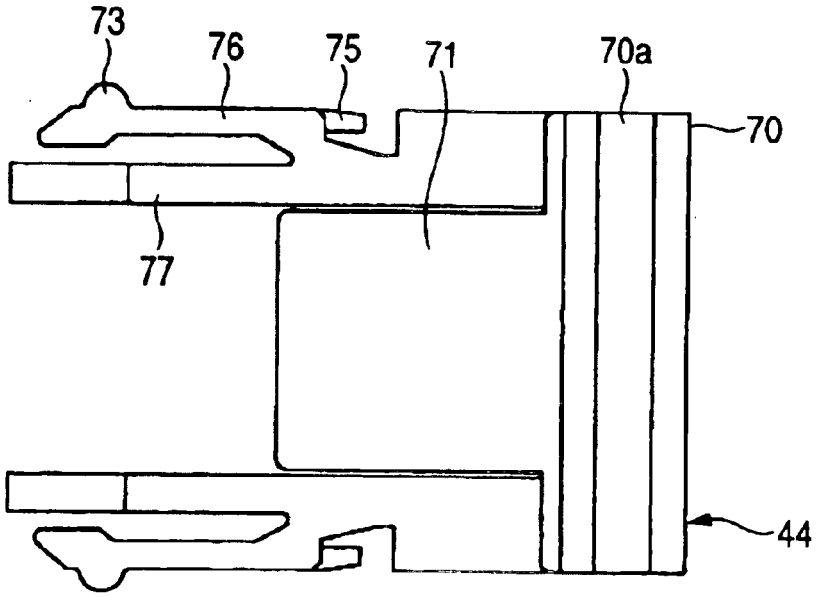
FIG. 15A is a top plan view showing an operating lever according to another preferred embodiment of the invention.
Figure 15B:
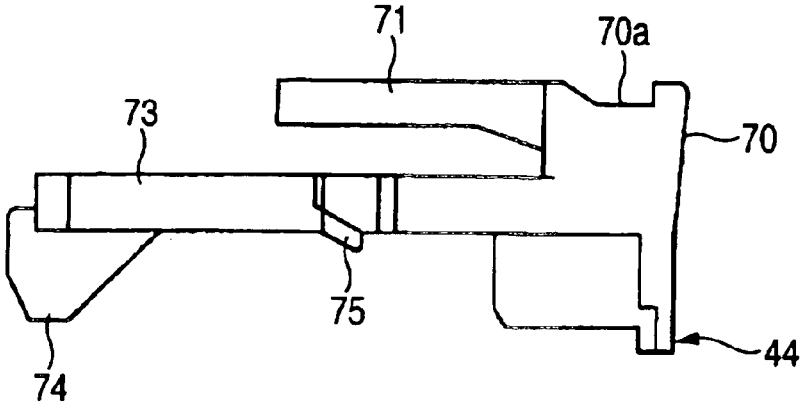
FIG. 15B is a front elevational view of the operating lever shown in FIG. 15A.

Incidentally, the operating lever 44 may have, instead of the above-mentioned construction, a construction in which, as shown in FIGS. 15A and 15B, the extending end of each of the engagement portions 72 is divided into a first elastic part 76 on which the elastic swollen portion 73 is formed and a second elastic part 77 on which the pressing projection 74 is formed. According to this construction, it is possible to independently carry out engagement and disengagement between the engagement receiving portion 65 of the cover 46 and the elastic swollen portions 73 of the first elastic parts 76 and application of pressures to the second pressure receiving portions 58 of the LED holder 43 by the respective pressing projections 74 of the second elastic parts 77. Accordingly, variations in the movement of the movable core 16, that is to say, variations in the amount of depression of the movable core 16 by the LED holder 43, can be absorbed by the elastic force of the second elastic parts 77.

As shown in FIG. 11, the display panel 45 has a predetermined visual display applied to its plate-like surface by printing or label sticking, and engagement claws 78 each having an approximately C-like cross section are respectively formed on the opposite end sides of the reverse surface of the display panel 45. The respective engagement claws 78 are brought into engagement with the mounting portions 68 which project into the respective communication holes 67 of the cover 46, thereby fixing the display panel 45 to the panel-fitting depressed portion 66. Since the engagement claws 78 are respectively provided at two locations on the opposite ends of the display panel 45, there is no risk of causing a warp or the like in the display panel 45, whereby it is possible to stabilize the mounted state of the display panel 45.

A method of assembling the above-mentioned electromagnetic relay will be described below.

In an advance step, the coil 13 is wound around the spool 12 fitted on the core 11 and the yoke 14 is fixed to the core 11 by caulking, thereby forming the coil block 2. The ends of each of the coils 13*a* and *13*b which are wound around the trunk portion of the spool 12 in the respective inner and outer circumferential portions are wound around the corresponding ones of the coil terminals 20 and 21 which are insert-molded on the flange portion 12*a* and the flange portion 12*b* of the spool 12.

First of all, the contact parts 24*a*, 25*a* and 26*a* are press-fitted into the base plate 1 from above, and the terminal portions 24*b*, 25*b* and 26*b* are projected from the bottom side of the base plate 1. Then, the indicator 31 is secured so that the support pins 34 are rotatably supported in the bearing holes 10. Then, the projection 28*a* provided at the extending end of the card 27 is inserted through the through-hole 24*c* of the movable contact part 24, and the respective guide receiving portions 30 are brought into engagement with the guide projections 35 of the indicator 31 to temporarily fix the card 27.

Then, the coil block 2 is placed on he base plate 1, and the terminal portions of the coil terminals 20 and 21 are projected from the bottom side of the base plate 1. Then, the movable core 16 is turnably disposed on the top end of the vertical plane portion of the yoke 14 as a fulcrum and is urged by the pressing part 15*a* of the hinge spring 15, and the connection portion 19 of the movable core 16 is connected to the rectangular hole 29 of the card 27. In this state, the urging force of the hinge spring 15 acts to move the attracted portion 17 of the movable core 16 away from the attraction surface 11*a* of the core 11, and the movable contact part 24 brings the movable contact 24*a* into contact with the first stationary contact 25*a*.

After the completion of the mounting of the contact opening and closing mechanism 3 and the coil block 2 on the base plate 1, the case 4 is placed on the base plate 1. At this time, the display part 32 of the indicator 31 is positioned in the display guide portion 38 of the case 4, and the electrical connection portions 23 of the first coil terminals 20 are projected upwardly through the slits 4*a* of the case 4.

Then, the LED 50 is incorporated into the LED holder 43, and the LED holder 43 is placed on the top side of the case 4. The LED holder 43 is inserted between the display guide portion 38 and the engagement part 39 of the case 4 and is fixed by the engagement claws 39*a*. The lead wires 54 extending from the LED 50 are welded to the electrical connection portions 23 of the first coil terminals 20 which project upwardly from the top side of the case 4. Since the ridges 23*a* are formed on the electrical connection portions 23, the electrical connection portions 23 can be positively connected to the lead wires 54.

Finally, the cover 46 is fitted on the top side of the case 4. The operating lever 44 and the display panel 45 are secured to the cover 46 in advance. The operating lever 44 is secured by being slid from one end side of the cover 46 into the opening 62. The display panel 45 is positioned in the depressed portion 63 from above the cover 46, and is secured by engaging the respective engagement claws 78 with the mounting portions 68.

The operation of the electromagnetic relay will be described below. When the coil 13 is in the demagnetized state where it is not energized, the movable contact part 24 is placed in an upright state by its own elastic force to hold the movable contact 24*a* in contact with the first stationary contact 25*a*. The movable core 16 is turned to move the attracted portion 17 away from the attraction surface 11*a* of the core 11, by the elastic force of the movable contact part 24 via the card 27. Accordingly, the indicator 31 turns about the support pins 34 in the counterclockwise direction as viewed in FIG. 4 together with the card 27. Accordingly, the user cannot view the display part 32 in the window portion 61 of the cover 46.

Then, when the coil 13 is energized and magnetized, the attracted portion 17 of the movable core 16 is attracted to the attraction surface 11*a* of the core 11, whereby the movable core 16 is turned in the clockwise direction as viewed in FIG. 4. Accordingly, the movable contact part 24 is moved via the card 27 so that the movable contact 24*a* moves away from the first stationary contact 25*a* and comes into contact with the second stationary contact 26*a*. In addition, with the movement of the card 27, the indicator 31 turns about the support pins 34 in the clockwise direction as viewed in FIG. 4. Accordingly, the display part 32 is externally visibly positioned in the window portion 61 of the cover 46. The user can therefore understand the operating state of the contact opening and closing mechanism 3 at a glance. Also, the LED 50 is lighted by energizing the coil 13, whereby the magnetized state of the coil block 2 can be understood at a glance.

Figure 13A:
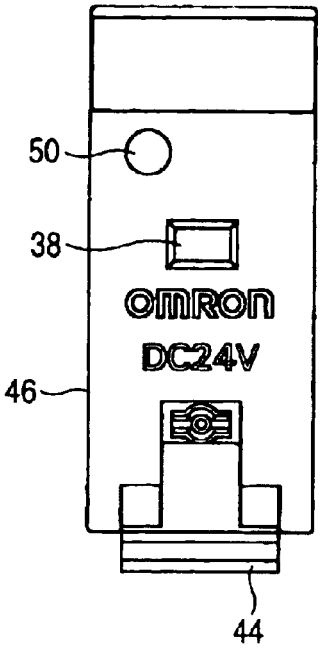
FIGS. 13A to 13C are views showing the state in which an operating lever is moved to a first opening position.
Figure 13B:
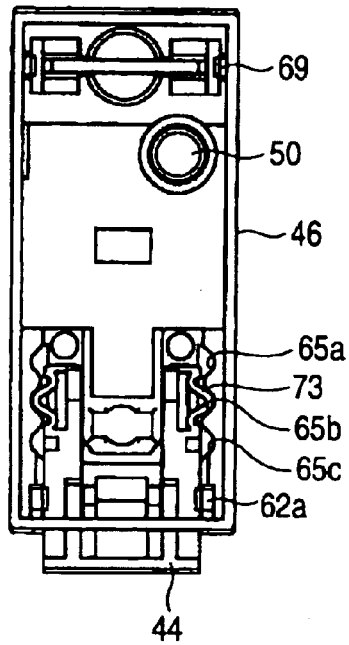
Figure 13C:
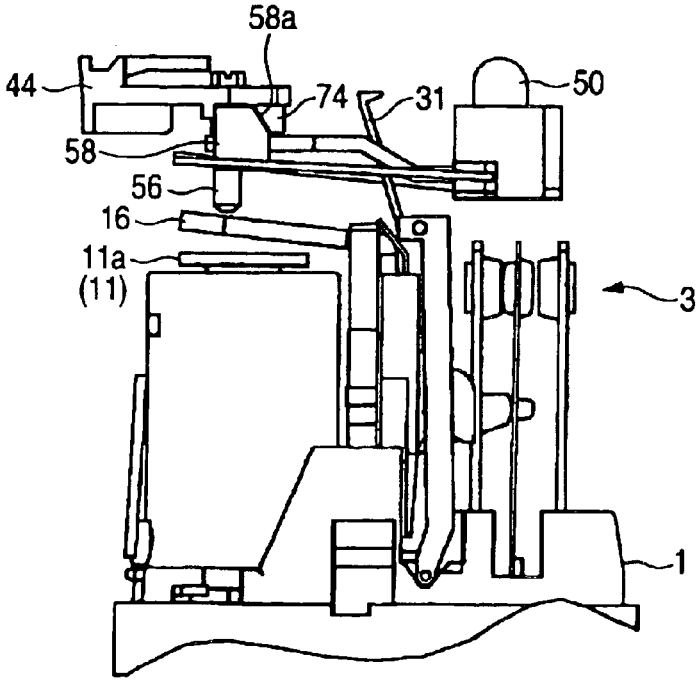
Figure 14A:
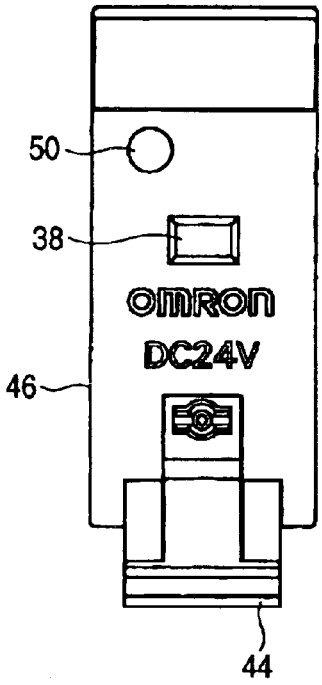
FIGS. 14A to 14C are views showing the state in which the operating lever is moved to a second opening position.
Figure 14B:
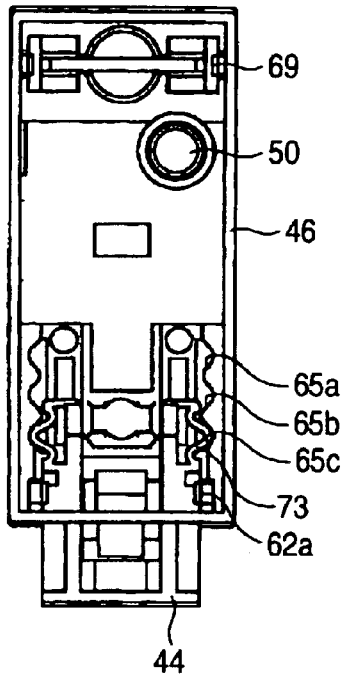

When the operating lever 44 is slid to the first opening position during the demagnetized state where the coil 13 is not energized, the first pressure receiving portion 57 of the LED holder 43 is exposed as shown in FIG. 13A. Accordingly, it becomes possible to depress the first pressure receiving portion 57. When the first pressure receiving portion 57 is depressed, the elastic arm portions 48 are elastically deformed and the pressing portion 56 is moved downwardly. Accordingly, the movable core 16 is turned to move the movable contact part 24 via the card 27. At this time, with the movement of the card 27, the indicator 31 turns and the display part 32 becomes visible in the window portion 61. Namely, the user can view the operating state of the movable core 16.

Figure 14C:
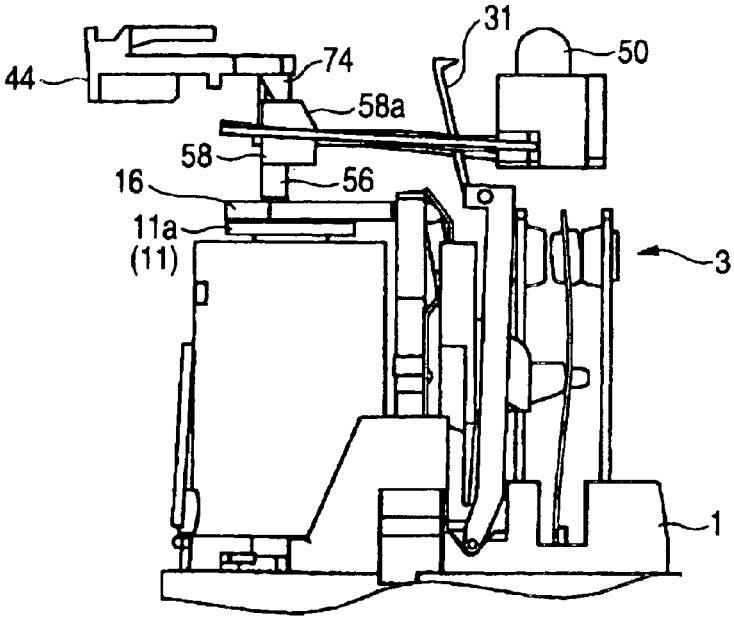

When the operating lever 44 is further slid from the first opening position to the second opening position, the pressing projections 74 of the operating lever 44 press the second pressure receiving portions 58 of the LED holder 43 to elastically deform the elastic arm portions 48, as shown in FIG. 14C. Accordingly, the pressing projections 74 press the operating portion 49 of the LED holder 43 downwardly, whereby the movable core 16 is maintained in a pressed state by the pressing portion 56 and the movable contact 24*a* is brought into contact with the second stationary contact 26*a*. At this time, the display part 32 of the indicator 31 becomes visible in the window portion 61 of the cover 46. Namely, the user can view the operating state of the movable core 16.

Incidentally, in the above-mentioned embodiment, the single movable contact 24*a* is brought into and out of contact with the two stationary contacts 25*a* and 26*a*, but it is also preferable to adopt a construction in which two movable contacts are brought into and out of contact with two stationary contacts, respectively.

Figure 16:
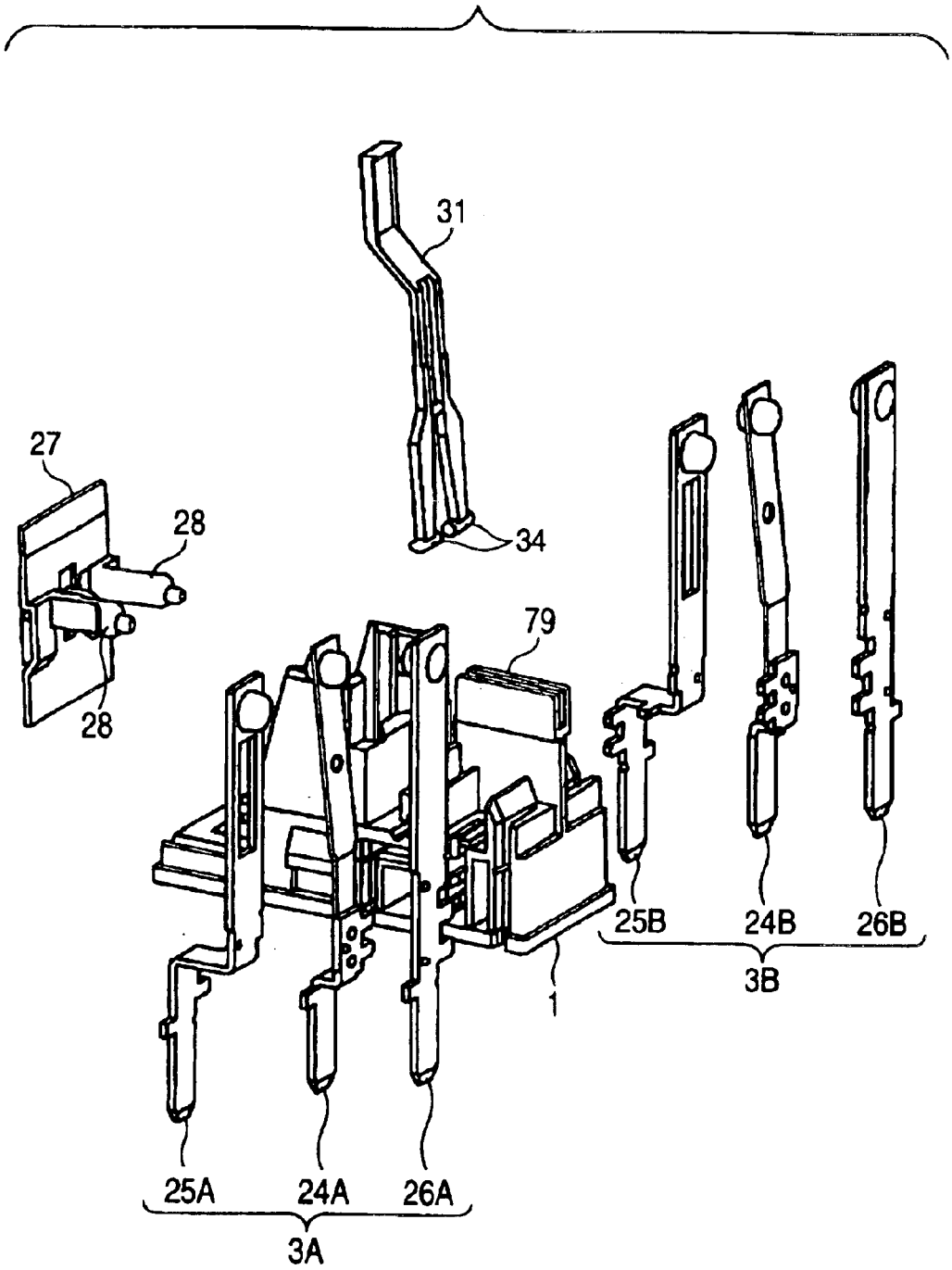
FIG. 16 is an exploded perspective view showing a base block and a contact opening and closing mechanism according to another preferred embodiment of the invention.

In this case, as shown in FIG. 16, the base plate 1 is constructed so that two contact opening and closing mechanisms 3, one of which includes a movable contact part 24A and a pair of first stationary contact part 25A and 26A and the other of which includes a movable contact part 24B and a pair of first stationary contact part 25B and 26B, can be press-fitted into the opposite side portions of the base plate 1. The second area is divided into two areas in the width direction by a fourth partition wall 79 so that the two contact opening and closing mechanisms 3 can be insulated from each other. The indicator 31 is bifurcated in its lower half, and the support pins 34 which project toward each other are respectively formed at the bottom ends of the bifurcated portions. The respective support pins 34 are rotatably supported in bearing holes (not shown) formed in the fourth partition wall 79. The card 27 is provided with two press-inserting projecting portions 28 at opposite side locations for pressing the respective movable contact parts 24. The other constructions are substantially the same as those of the above-described embodiment, and the descriptions of the same constructions are omitted.

Although in the above-described embodiment the card 27 and the indicator 31 are separately constructed, they may also be integrally constructed.

Figure 17B:
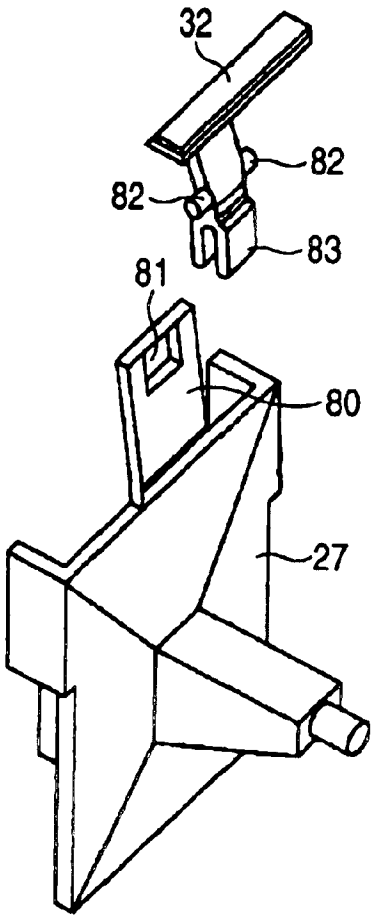
FIGS. 17A and 17B are perspective views of different cards according to another preferred embodiment of the invention.
Figure 17A:
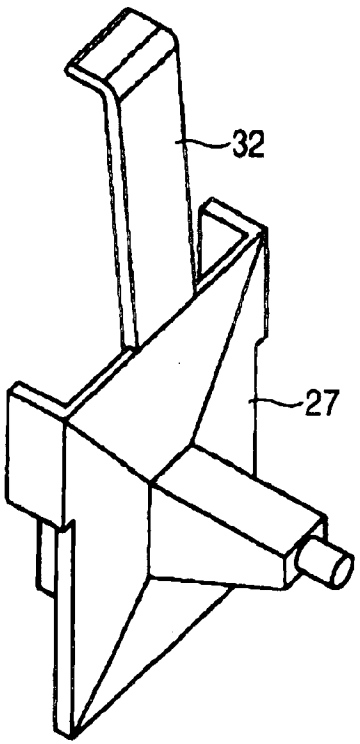

In FIG. 17A, the display part 32 is integrally formed on the central portion of the top edge of the card 27.

In FIG. 17B, an extended portion 80 is formed on the central portion of the top edge of the card 27, and the display part 32 is joined to this extended portion 80. Specifically, the display part 32 is secured to the case 4 for turning movement about support pins 82, and an engagement part 83 of the display part 32 is rotatably joined to an engagement receiving hole 81 formed in the extended portion 80. Accordingly, the turning range of the display part 32 can be made wide compared to the case where the display part 32 is extended directly from the card 27. Accordingly, even in a small-size electromagnetic relay in which the amount of movement of the card 27 is small, since the movement of the display part 32 can be amplified, it is possible to realize a construction which enables the user to positively confirm the movement of the display part 32. In addition, since the display part 32 is turnably provided in the case 4, the space occupied by the display part 32 can be reduced, whereby the overall size of the electromagnetic relay can be reduced.

Figure 18:
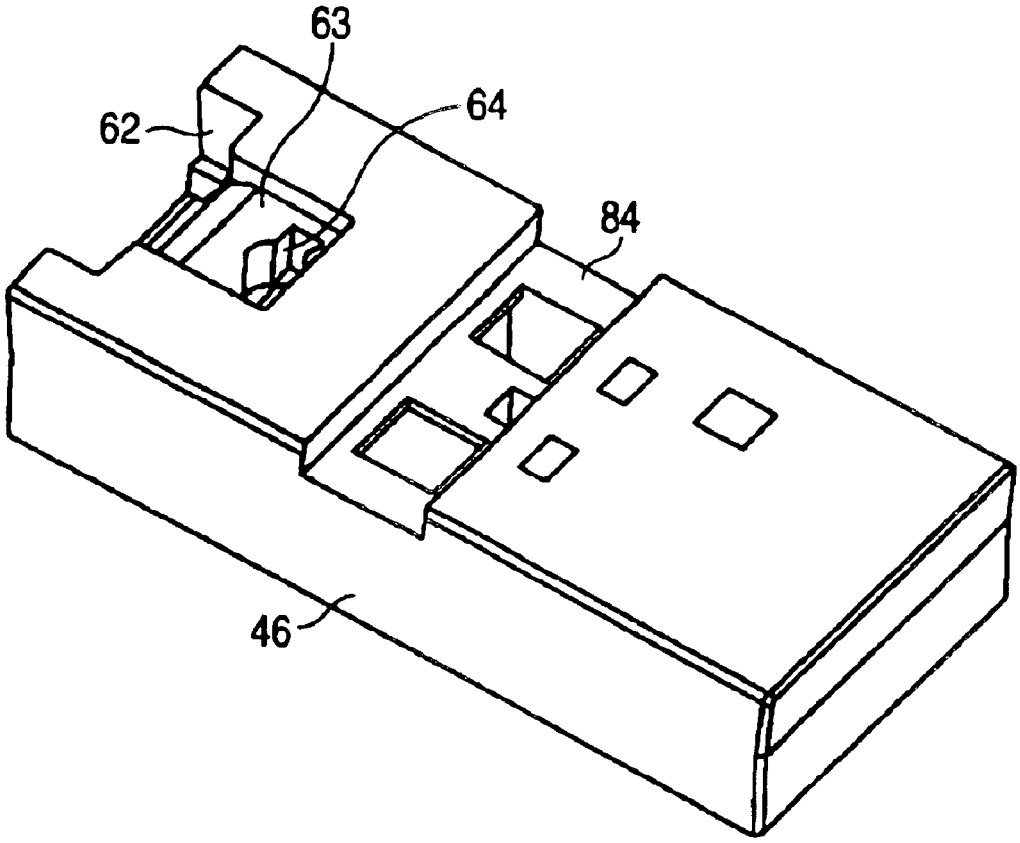
FIG. 18 is a perspective view of a cover according to another preferred embodiment of the invention.

In this case, the cover 46 can be modified as shown in FIG. 18 by way of example. Specifically, the panel-fitting depressed portion 66 is formed in the central portion of the cover 46, and the display panel 45 may be secured to this depressed portion 66 formed in the central portion.

As is apparent from the foregoing description, according to the invention, a light-emitting device can be disposed on a top side of a case by holding the light-emitting device by a holder, whereby it is possible to improve the visibility of the light-emitting device. Also, since the light-emitting device is disposed outside, it is possible to surely prevent dust or the like from entering into an interior of the case.

What is claimed is:

1. An electromagnetic relay provided with a coil block and a contact opening and closing mechanism which are disposed on a base plate and covered with a case, and operative to magnetize and demagnetize the coil block to turn a movable core and move a movable contact part to open and close a contact, comprising:

a light-emitting device which emits light during magnetization of the coil block; and a holder which holds the light-emitting device, the light-emitting device and the holder being disposed on a top side of the case, wherein the case includes an engagement part which is elastically deformed while the holder is being mounted, and is restored to its original shape after the holder has been mounted, the engagement part having a top end portion where an engagement claw to engage with a top edge portion of the holder is formed.

2. An electromagnetic relay according to claim 1, wherein the case is molded from a resin and has engagement holes with which engagement projections provided on the base plate are respectively brought into engagement, the engagement claw of the engagement part being able to be formed with a slide mold which forms the engagement holes.

3. An electromagnetic relay according to claim 1, wherein the holder includes a holder body which holds the light-emitting device, an operating portion which moves the movable core by directly pressing the movable core through a depressing operation of the operating portion, and elastic arm portions which connect the holder body and the operating portion and are elastically deformed by the depressing operation of the operating portion.

4. An electromagnetic relay according to claim 3, further comprising an indicator to be driven with a turning movement of the movable core, and a display guide portion which provides a space in which the indicator part can move being disposed to project from a central portion of the top side of the case, the holder body of the holder being positioned between the engagement part and the display guide portion.

5. An electromagnetic relay according to claim 2, wherein the holder includes a holder body which holds the light-emitting device, an operating portion which moves the movable core by directly pressing the movable core through a depressing operation of the operating portion, and elastic arm portions which connect the holder body and the operating portion and are elastically deformed by the depressing operation of the operating portion.

* * * * *